US005800862A

United States Patent [19]

Kaufmann et al.

[11] Patent Number: 5,800,862

[45] Date of Patent: Sep. 1, 1998

[54] TEXTILE TREATMENT

[75] Inventors: Werner Kaufmann, Rheinfelden, Switzerland; Dieter Reinehr, Kandern, Germany; Rolf Hilfiker, Basel, Switzerland

[73] Assignee: Ciba Specialty Chemicals Corporation, Tarrytown, N.Y.

[21] Appl. No.: 438,590

[22] Filed: May 10, 1995

[30] Foreign Application Priority Data

May 12, 1994 [GB] United Kingdom ..... 9409466

[51] Int. Cl.[6] ..... B05D 5/00

[52] U.S. Cl. ..... 427/458; 427/160; 427/384

[58] Field of Search ..... 427/160, 158, 427/384; 252/301.16, 301.24, 301.28

[56] References Cited

U.S. PATENT DOCUMENTS

| | | | |
|---|---|---|---|
| 2,702,296 | 2/1955 | Sartori | 252/102 |
| 3,656,991 | 4/1972 | Blackwell et al. | 427/158 |
| 3,971,731 | 7/1976 | Hartman et al. | 427/158 |
| 4,028,263 | 6/1977 | Gray | 252/97 |
| 4,460,374 | 7/1984 | Abel et al. | 427/158 |
| 4,559,150 | 12/1985 | Becker et al. | 427/158 |
| 4,950,304 | 8/1990 | Reinert et al. | 8/566 |
| 5,057,236 | 10/1991 | Petrin | 252/79.1 |
| 5,319,090 | 6/1994 | MacLeay | 548/257 |
| 5,336,447 | 8/1994 | Clements | 252/554 |

FOREIGN PATENT DOCUMENTS

| | | |
|---|---|---|
| 0992969 | 5/1965 | United Kingdom . |
| 0994346 | 6/1965 | United Kingdom . |
| WO94/04515 | 3/1994 | WIPO . |

OTHER PUBLICATIONS

Derwent Abstract 93–191992/24–JP5117910 A, May, 1993.

*Primary Examiner*—Janyce Bell
*Attorney, Agent, or Firm*—Kevin T. Mansfield

[57] ABSTRACT

The present invention relates to a improving the sun protection factor (SPF) of textile fibre material comprising treating the textile fibre material with a composition comprising at least one flourescent whitening agent which absorbs radiation in the wavelength range 280–400 nm.

54 Claims, No Drawings

TEXTILE TREATMENT

TEXTILE TREATMENT

The present invention relates to a method of improving the sun protection factor (SPF) of textile fibre material comprising treating the textile fibre material with a composition comprising at least one fluorescent whitening agent which absorbs radiation in the wavelength range 280–400 nm.

It is known that light radiation of wavelengths 280–400 nm permits tanning of the epidermis. Also known is that rays of wavelengths 280–320 nm (termed UV-B radiation), cause erythemas and skin burning which can inhibit skin tanning.

Radiation of wavelengths 320–400 nm (termed UV-A radiation) is known to induce skin tanning but can also cause skin damage, especially to sensitive skin which is exposed to sunlight for long periods. Examples of such damage include loss of skin elasticity and the appearance of wrinkles, promotion of the onset of erythemal reaction and the inducement of phototoxic or photoallergic reactions.

Any effective protection of the skin from the damaging effects of undue exposure to sunlight clearly needs to include means for absorbing both UV-A and UV-B components of sunlight before they reach the skin surface.

Traditionally, protection of exposed human skin against potential damage by the UV components in sunlight has been effected by directly applying to the skin a preparation containing a UV absorber. In areas of the world, e.g. Australia and America, which enjoy especially sunny climates, there has been a great increase in the awareness of the potential hazards of undue exposure to sunlight, compounded by fears of the consequences of alleged damage to the ozone layer. Some of the more distressing embodiments of skin damage caused by excessive, unprotected exposure to sunlight are development of melanomas or carcinomas on the skin.

One aspect of the desire to increase the level of skin protection against sunlight has been the consideration of additional measures, over and above the direct protection of the skin. For example, consideration has been given to the provision of protection to skin covered by clothing and thus not directly exposed to sunlight.

Most natural and synthetic textile materials are at least partially permeable to UV components of sunlight. Accordingly, the mere wearing of clothing does not necessarily provide skin beneath the clothing with adequate protection against damage by UV radiation. Although clothing containing a deeply coloured dye and/or having a tight weave texture may provide a reasonable level of protection to skin beneath it, such clothing is not practical in hot sunny climates, from the standpoint of the personal comfort of the wearer.

There is a need, therefore, to provide protection against UV radiation for skin which lies underneath clothing, including lightweight summer clothing, which is undyed or dyed only in pale shades. Depending on the nature of the dyestuff, even skin beneath clothing dyed in some dark shades may also require protection from UV radiation.

Such lightweight summer clothing normally has a density of of less than 200 g/m$^2$ and has a sun protection factor rating between 1.5 and 20, depending on the type of fibre from which the clothing is manufactured.

The SPF rating of a sun protectant (sun cream or clothing) may be defined as the multiple of the time taken for the average person wearing the sun protectant to suffer sun burning under average exposure to sun. For example, if an average person would normally suffer sun burn after 30 minutes under standard exposure conditions, a sun protectant having an SPF rating of 5 would extend the period of protection from 30 minutes to 2 hours and 30 minutes. For people living in especially sunny climates, where mean sun burn times are minimal, e.g. only 15 minutes for an average fair-skinned person at the hottest time of the day, SPF ratings of at least 20 are desired for lightweight clothing.

Surprisingly, it has now been found that treating a textile fibre material with a composition comprising at least one particular fluorescent whitening agent which can also serve as a UV (ultra-violet) radiation absorber, namely one which absorbs radiation in the wavelength range 280–400 nm, imparts an excellent sun protection factor to the fibre material so treated.

Accordingly, the present invention provides a method of improving the sun protection factor (SPF) of textile fibre material, comprising treating the textile fibre material with a composition comprising at least one fluorescent whitening agent which absorbs radiation in the wavelength range 280–400 nm.

The textile fibre material treated according to the method of the present invention may be composed of a wide variety of natural or synthetic fibres, e.g., wool, polyamide, cotton, polyester, polyacrylic, silk, polypropylene or mixtures thereof.

The textile fibre material may be in the form of endless filaments (stretched or unstretched), staple fibres, flocks, hanks, textile filament yarns, threads, nonwovens, felts, waddings, flocked structures or woven textile or bonded textile fabrics or knitted fabrics.

The amount of fluorescent whitening agent present in the composition used according to the method of the present invention preferably ranges from 0.01 to 3%, especially from 0.05 to 1%, based on the weight of the textile fibre material.

The fluorescent whitening agent used may be selected from a wide range of chemical types such as 4,4'-bis-(triazinylamino)-stilbene-2,2'-disulfonic acids, 4,4'-bis-(triazol-2-yl)stilbene-2,2'-disulfonic acids, 4,4'-(diphenyl)-stilbenes, 4,4'-distyryl-biphenyls, 4-phenyl-4'-benzoxazolyl-stilbenes, stilbenyl-naphthotriazoles, 4-styryl-stilbenes, bis-(benzoxazol-2-yl) derivatives, bis-(benzimidazol-2-yl) derivatives, coumarines, pyrazolines, naphthalimides, triazinyl-pyrenes, 2-styryl-benzoxazole- or -naphthoxazole derivatives, benzimidazole-benzofuran derivatives or oxanilide derivatives.

Preferred 4,4'-bis-(triazinylamino)-stilbene-2,2'-disulfonic acids are those having the formula:

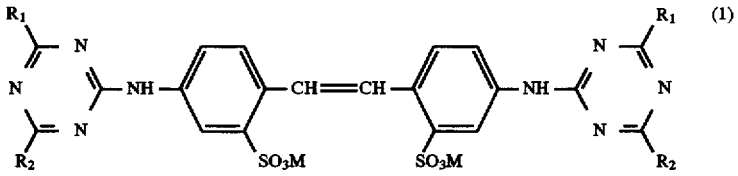

(1)

in which $R_1$ and $R_2$, independently, are phenyl, mono- or disulfonated phenyl, phenylamino, mono- or disulfonated phenylamino, morpholino, —$N(CH_2CH_2OH)_2$, —$N(CH_3)(CH_2CH_2OH)$, —$NH_2$, —$N(C_1$–$C_4$-alkyl$)_2$, —$OCH_3$, —Cl, —NH—$CH_2CH_2SO_3H$ or —NH—$CH_2CH_2OH$; and M is H, Na, K, Ca, Mg, ammonium, mono-, di-, tri- or tetra-$C_1$–$C_4$-alkylammonium, mono-, di- or tri-$C_1$–$C_4$-hydroxyalkylammonium or ammonium that is di- or tri-substituted with by a mixture of $C_1$–$C_4$-alkyl and $C_1$–$C_4$-hydroxyalkyl groups.

Especially preferred compounds of formula (1) are those in which each $R_1$ is 2,5-disulfophenyl and each $R_2$ is morpholino; or each $R_1$ is 2,5-disulfophenyl and each $R_2$ is $N(C_2H_5)_2$; or each $R_1$ is 3-sulfophenyl and each $R_2$ is $NH(CH_2CH_2OH)$ or $N(CH_2CH_2OH)_2$; or each $R_1$ is 4-sulfophenyl and each $R_2$ is $N(CH_2CH_2OH)_2$; and, in each case, the sulfo group is $SO_3M$ in which M is sodium.

Preferred 4,4'-bis-(triazol-2-yl)stilbene-2,2'-disulfonic acids are those having the formula:

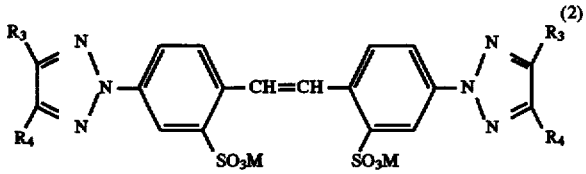

(2)

in which $R_3$ and $R_4$, independently, are H, $C_1$–$C_4$-alkyl, phenyl or monosulfonated phenyl; and M has its previous significance.

Especially preferred compounds of formula (2) are those in which $R_3$ is phenyl, $R_4$ is H and M is sodium.

One preferred 4,4'-(diphenyl)-stilbene is that having the formula:

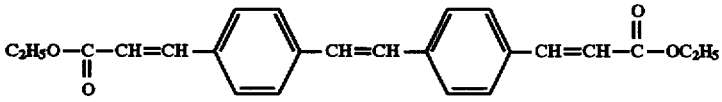

(3)

Preferably, 4,4'-distyryl-biphenyls used are those of formula:

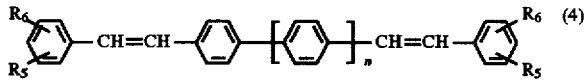

(4)

in which $R_5$ and $R_6$, independently, are H, $SO_3M$, $SO_2N(C_1$–$C_4$-alkyl$)_2$, O—($C_1$–$C_4$-alkyl), CN, Cl, $COO(C_1$–$C_4$-alkyl), $CON(C_1C_4$-alkyl$)_2$ or $O(CH_2)_3N^{\oplus}(CH_3)_2An^{\ominus}$ in which $An^{\ominus}$ is an anion of an organic or inorganic acid, in particular a formate, acetate, propionate, glcolate, lactate, acrylate, methanephosphonate, phosphite, dimethyl or diethyl phosphite anion, or a mixture thereof, and n is 0 or 1.

Especially preferred compounds of formula (4) are those in which n is 1 and each $R_5$ is a 2-$SO_3M$ group in which M is sodium and each $R_6$ is H, or each $R_5$ is $O(CH_2)_3N^{\oplus}(CH_3)_2An^{\ominus}$ in which $An^{\ominus}$ is acetate.

Preferred 4-phenyl-4'-benzoxazolyl-stilbenes have the formula:

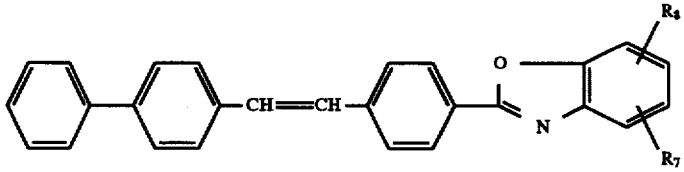

(5)

in which $R_7$ and $R_8$, independently, are H, Cl, $C_1$–$C_4$-alkyl or $SO_2$—$C_1$–$C_4$-alkyl.

An especially preferred compound of formula (5) is that in which $R_7$ is 4-$CH_3$ and $R_8$ is 2-$CH_3$.

Preferably, stilbenyl-naphthotriazoles used are those of formula:

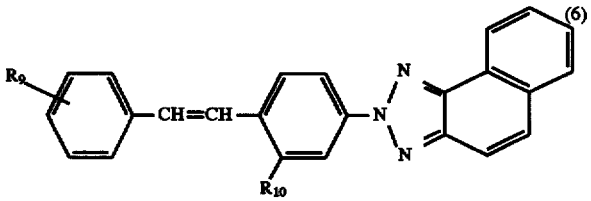

(6)

in which $R_9$ is H or Cl; $R_{10}$ is $SO_3M$, $SO_2N(C_1$–$C_4$-alkyl$)_2$, $SO_2O$-phenyl or CN; $R_{11}$ are H or $SO_3M$; and M has its previous significance.

Especially preferred compounds of formula (6) are those in which $R_9$ and $R_{11}$ are H and $R_{10}$ is 2-$SO_3M$ in which M is Na.

Preferably, 4-styryl-stilbenes used are those of formula:

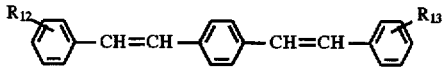

(7)

in which $R_{12}$ and $R_{13}$, independently, are H, $SO_3M$, $SO_2N(C_1-C_4\text{-alkyl})_2$, O—($C_1$–$C_4$-alkyl), CN, Cl, $COO(C_1-C_4\text{-alkyl})$, $CON(C_1-C_4\text{-alkyl})_2$ or $O(CH_2)_3N^{\oplus}(CH_3)_2An^{\ominus}$ in which $An^{\ominus}$ is an anion of an organic or inorganic acid, in particular a formate, acetate, propionate, glcolate, lactate, acrylate, methanephosphonate, phosphite, dimethyl or diethyl phosphite anion , or a mixture thereof.

Especially preferred compounds of formula (7) are those in which each of $R_{12}$ and $R_{13}$ is 2-cyano, 2-$SO_3M$ in which M is sodium or $O(CH_2)_3N^{\oplus}(CH_3)_2An^{\ominus}$ in which $An^{\ominus}$ is acetate.

Preferred bis-(benzoxazol-2-yl) derivatives are those of formula:

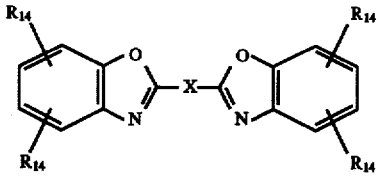

(8)

in which $R_{14}$, independently, is H, $C(CH_3)_3$, $C(CH_3)_2$-phenyl, $C_1$–$C_4$-alkyl or COO—$C_1$–$C_4$-alkyl, and X is —CH=CH— or a group of formula:

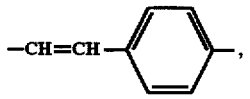

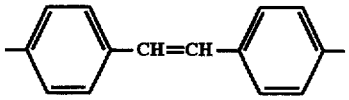

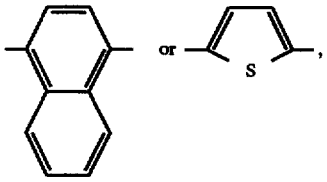

Especially preferred compounds of formula (8) are those in which each $R_{14}$ is H and X is

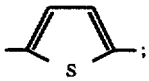

or one group $R_{14}$ in each ring is 2-methyl and the other $R_{14}$ is H and X is —CH=CH—; or one group $R_{14}$ in each ring is 2-$C(CH_3)_3$ and the other $R_{14}$ is H and X is

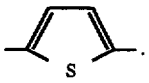

Preferred bis-(benzimidazol-2-yl) derivatives are those of formula:

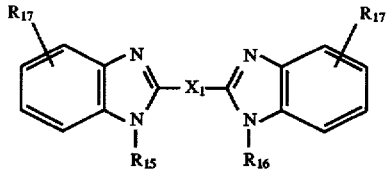

(9)

in which $R_{15}$ and $R_{16}$, independently, are H, $C_1$–$C_4$-alkyl or $CH_2CH_2OH$; $R_{17}$ is H or $SO_3M$; $X_1$ is —CH=CH— or a group of formula:

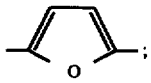

and M has its previous significance.

Especially preferred compounds of formula (9) are those in which $R_{15}$ and $R_{16}$ are each H, $R_{17}$ is $SO_3M$ in which M is sodium and $X_1$ is —CH=CH—.

Preferred coumarines are those of formula:

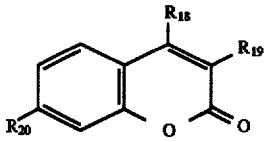

(10)

in which $R_{18}$ is H, Cl or $CH_2COOH$, $R_{19}$ is H, phenyl, COO—$C_1$–$C_4$-alkyl or a group of formula:

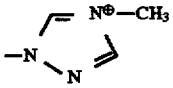

and $R_{20}$ is O—$C_1$–$C_4$-alkyl, $N(C_1-C_4\text{-alkyl})_2$, NH—CO—$C_1$–$C_4$-alkyl or a group of formula:

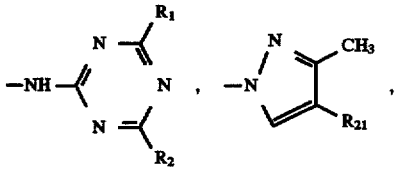

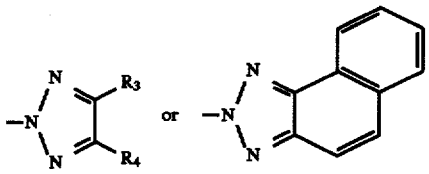

in which $R_1$, $R_2$, $R_3$ and $R_4$ have their previous significance and $R_{21}$ is H, $C_1$–$C_4$-alkyl or phenyl.

Especially preferred compounds of formula (10) are those having the formula:

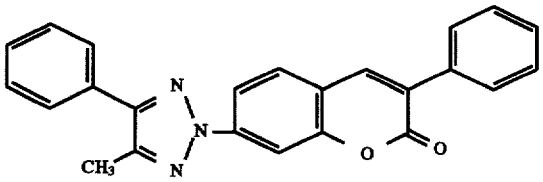

(11)

or

-continued

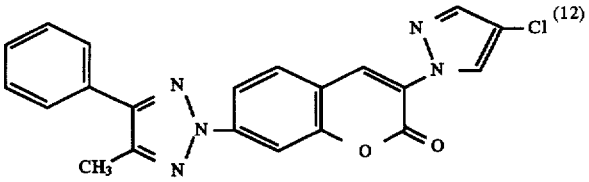

(12)

Preferably, pyrazolines used are those having the formula:

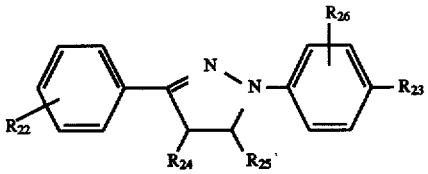

(13)

in which $R_{22}$ is H, Cl or $N(C_1-C_4\text{-alkyl})_2$, $R_{23}$ is H, Cl, $SO_3M$, $SO_2NH_2$, $SO_2NH—(C_1-C_4\text{-alkyl})$, $COO—C_1-C_4$-alkyl, $SO_2—C_1-C_4$-alkyl, $SO_2NHCH_2CH_2CH_2N^{\oplus}(CH_3)_3$ or $SO_2CH_2CH_2N^{\oplus}H(C_1-C_4\text{-alkyl})_2\ An^{\ominus}$, $R_{24}$ and $R_{25}$ are the same or different and each is H, $C_1-C_4$-alkyl or phenyl and $R_{26}$ is H or Cl; and $An^{\ominus}$ and M have their previous significance.

Especially preferred compounds of formula (13) are those in which $R_{22}$ is Cl, $R_{23}$ is $SO_2CH_2CH_2N^{\oplus}H(C_1-C_4\text{-alkyl})_2\ An^{\ominus}$ in which $An^{\ominus}$ is phosphite and $R_{24}$, $R_{25}$ and $R_{26}$ are each H; or those those having the formula:

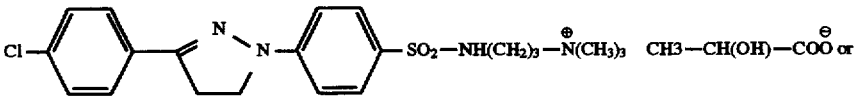

(14)

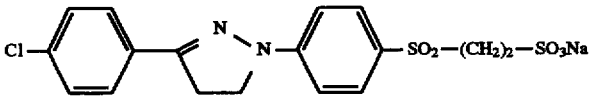

(15)

Preferred naphthalimides are those of formula:

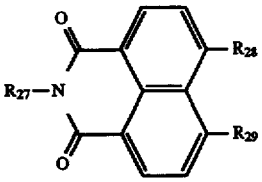

(16)

in which $R_{27}$ is $C_1-C_4$-alkyl or $CH_2CH_2CH_2N^{\oplus}(CH_3)_3$; $R_{28}$ and $R_{29}$, independently, are $O—C_1-C_4$-alkyl, $SO_3M$ or $NH—CO—C_1-C_4$-alkyl; and M has its previous significance.

Especially preferred compounds of formula (16) are those having the formula:

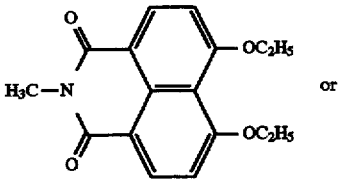

(17)

-continued

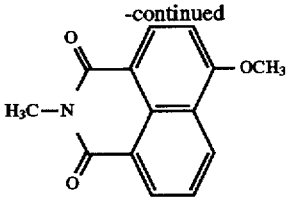

(18)

Preferred triazinyl-pyrenes used are those of formula:

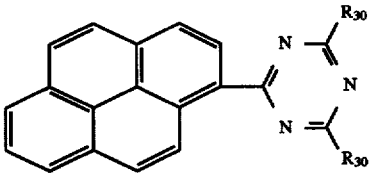

(19)

in which each $R_{30}$, independently, is $C_1-C_4$-alkoxy.

Especially preferred compounds of formula (19) are those in which each $R_{30}$ is methyl.

Preferred 2-styryl-benzoxazole- or -naphthoxazole derivatives are those having the formula:

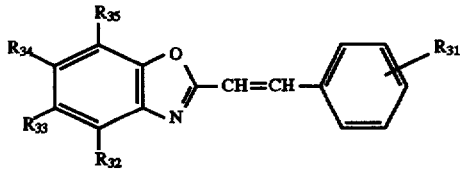

(20)

in which $R_{31}$ is CN, Cl, $COO—C_1-C_4$-alkyl or phenyl; $R_{32}$ and $R_{33}$ are the atoms required to form a fused benzene ring or $R_{33}$ and $R_{35}$, independently, are H or $C_1-C_4$-alkyl; and $R_{34}$ is H, $C_1-C_4$-alkyl or phenyl.

Especially preferred compounds of formula (20) are those in which $R_{31}$ is a 4-phenyl group and each of $R_{32}$ to $R_{35}$ is H.

Preferred benzimidazole-benzofuran derivatives are those having the formula:

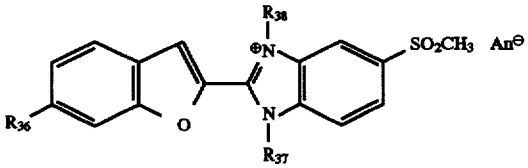

(21)

in which $R_{36}$ is $C_1-C_4$-alkoxy; $R_{37}$ and $R_{38}$, independently, are $C_1-C_4$-alkyl; and $An^{\ominus}$ has its previous significance.

A particularly preferred compound of formula (21) is that in which $R_{36}$ is methoxy, $R_{37}$ and $R_{38}$ are each methyl and $An^{63}$ is methane sulfonate.

Preferred oxanilide derivatives include those having the formula:

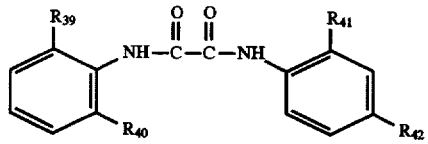

(22)

in which $R_{39}$ is $C_1$–$C_4$alkoxy, $R_{41}$ is $C_1$–$C_4$alkyl, $C_1$–$C_4$alkyl-$SO_3M$ or $C_1$–$C_4$alkoxy-$SO_3M$ in which M has its previous significance and $R_{40}$ and $R_{42}$ are the same and each is hydrogen, tert. butyl or $SO_3M$ in which M has its previous significance.

The fluorescent whitening agent may in used in various formulations such as:

a) in mixtures with dyes (shading) or pigments, especially white pigments;

b) in mixtures with carriers, wetting agents, antioxidants, e.g., sterically hindered amines, UV absorbers and/or chemical bleaching agents; or c) in admixture with crosslinking or finishing agents (such as starch or synthetic finishes), and in combination with a wide variety of textile finishing processes, especially synthetic resin finishes, e.g. creaseproof finishes (wash-and-wear, permanent press or non-iron), as well as flameproof finishes, soft handle finishes, antisoiling finishes, antistatic finishes or antimicrobial finishes.

Of particular interest is the co-use of the fluorescent whitening agent with a UV absorber.

The UV absorber used may be any of the wide range of known UV absorbers, that is organic compounds which readily absorb UV light, especially in the range λ=280 to 400 nm, and which convert the absorbed energy, by a chemical intermediate reaction, into non-interfering, stable compounds or into non-interfering forms of energy. The UV absorber used should, of course, be compatible with the rinse cycle fabric softener composition. Preferably, the UV absorber used is one which is capable of being absorbed on to the washed textile article during a rinse cycle fabric softener treatment.

The UV absorber used may be, e.g., an oxalic anilide, an o-hydroxybenzophenone, an o-hydroxyaryl-1,3,5-triazine, a sulphonated-1,3,5-triazine, an o-hydroxyphenylbenzotriazole, a 2-aryl-2H-benzotriazole, a salicylic acid ester, a substituted acrylonitrile, a substituted arylaminoethylene or a nitrilohydrazone.

Such known UV absorbers for use in the present invention are described, for example, in the U.S. Pat. Nos. 2,777,828, 2,853,521, 3,118,887, 3,259,627, 3,293,247, 3,382,183, 3,403,183, 3,423,360, 4,127,586, 4,141,903, 4,230,867, 4,675,352 and 4,698,064.

Preferred UV absorbers for use in the present invention include those of the benzo-triazine or benzo-triazole class.

One preferred class of benzo-triazine UV absorbers is that having the formula:

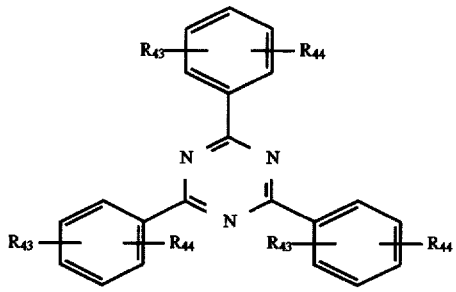

(23)

in which $R_{43}$ and $R_{44}$, independently, are hydrogen, hydroxy or $C_1$–$C_5$alkoxy.

A second preferred class of triazine UV absorbers is that having the formula:

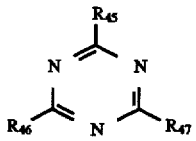

(24)

in which at least one of $R_{45}$, $R_{46}$ and $R_{47}$ is a radical of formula:

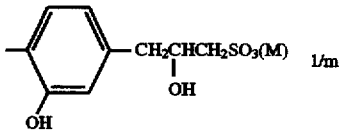

(25)

in which M has its previous significance; m is 1 or 2; and the remaining substituent(s) $R_{45}$, $R_{46}$ and $R_{47}$ are, independently, amino, $C_1$–$C_{12}$alkyl, $C_1$–$C_{12}$alkoxy, $C_1$–$C_{12}$alkylthio, mono- or di-$C_1$–$C_{12}$alkylamino, phenyl, phenylthio, anilino or N-phenyl-N-$C_1$–$C_4$alkylamino, preferably N-phenyl-N-methylamino or N-phenyl-N-ethylamino, the respective phenyl substituents being optionally substituted by $C_1$–$C_{12}$alkyl or -alkoxy, $C_5$–$C_8$cycloalkyl or halogen.

A third preferred class of triazine UV absorbers is that having the formula:

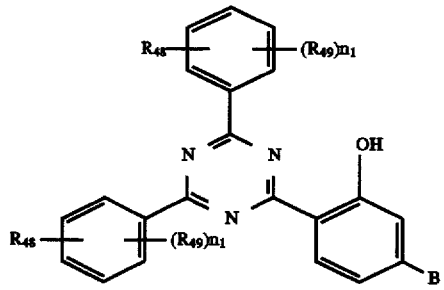

(26)

in which $R_{44}$ is hydrogen or hydroxy; $R_{45}$, independently, are hydrogen or $C_1$–$C_4$alkyl; $n_1$ is 1 or 2; and B is a group of formula:

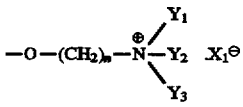

in which n is an integer from 2 to 6 and is preferably 2 or 3; $Y_1$ and $Y_2$, independently, are $C_1$–$C_4$alkyl optionally substituted by halogen, cyano, hydroxy or $C_1$–$C_4$alkoxy or $Y_1$ and $Y_2$, together with the nitrogen atom to which they are each attached, form a 5–7 membered heterocyclic ring, preferably a morpholine, pyrrolidine, piperidine or hexamethyleneimine ring; $Y_3$ is hydrogen, $C_3$–$C_4$alkenyl or $C_1$–$C_4$alkyl optionally substituted by cyano, hydroxy or $C_1$–$C_4$alkoxy or $Y_1$, $Y_2$ and $Y_3$, together with the nitrogen atom to which they are each attached, form a pyridine or picoline ring; and $X_1^{\ominus}$ is a colourless anion, preferably $CH_3OSO_3^{\ominus}$ or $C_2H_5OSO_3^{\ominus}$.

One preferred class of triazole UV absorbers is that having the formula:

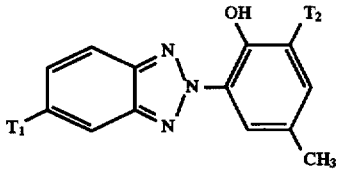

(27)

in which $T_1$ is chlorine or, preferably, hydrogen; and $T_2$ is a random statistical mixture of at least three isomeric branched sec. $C_8$–$C_{30}$, preferably $C_8$–$C_{16}$, especially $C_9$–$C_{12}$alkyl groups, each having the formula —$CH(E_1)(E_2)$ in which $E_1$ is a straight chain $C_1$–$C_4$alkyl group and $E_2$ is a straight chain $C_4$–$C_{15}$alkyl group, the total number of carbon atoms in $E_1$ and $E_2$ being from 7 to 29.

A second preferred class of triazole UV absorbers is that having the formula:

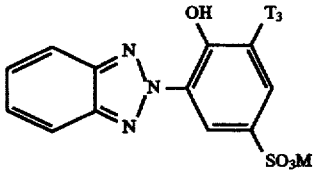

(28)

in which M has its previous significance, but is preferably sodium, and $T_3$ is hydrogen, $C_1$–$C_{12}$alkyl or benzyl.

A third preferred class of triazole UV absorbers is that having the formula:

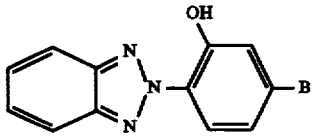

(29)

in which B has its previous significance.

In the compounds of formulae (23) to (29), $C_1$–$C_{12}$Alkyl groups $R_{45}$, $R_{46}$, $R_{47}$ and $T_3$ may be methyl, ethyl, n-propyl, isopropyl, n-butyl, isobutyl, tert.-butyl,n-amyl, n-hexyl, n-heptyl, n-octyl, isooctyl, n-nonyl, n-decyl, n-undecyl and n-dodecyl, methyl and ethyl being preferred, except in the case of $T_3$ for which isobutyl is preferred. $C_8$–$C_{30}$alkyl groups $T_2$ include sec.octyl, decyl, dodecyl, tridecyl, tetradecyl, hexadecyl, octadecyl, eicosyl and triacontyl groups.

$C_1$–$C_5$Alkoxy groups $R_{43}$ or $R_{44}$ may be, e.g., methoxy, ethoxy, n-propoxy, isopropoxy, n-butoxy, isobutoxy, tert.-butoxy or n-amyloxy, preferably methoxy or ethoxy, especially methoxy. $C_1$–$C_{12}$Alkoxy groups $R_{45}$, $R_{46}$ and $R_{47}$ include those indicated for the $C_1$–$C_5$alkoxy groups $R_{43}$ or $R_{44}$ together with, e.g., n-hexoxy, n-heptoxy, n-octoxy, isooctoxy, n-nonoxy, n-decoxy, n-undecoxy and n-dodecoxy, methoxy and ethoxy being preferred.

$C_1$–$C_{12}$Alkylthio groups $R_{45}$, $R_{46}$ and $R_{47}$ may be, e.g., methylthio, ethylthio, n-propylthio, isopropylthio, n-butylthio, isobutylthio, tert.-butylthio, n-amylthio, hexylthio, n-heptylthio, n-octylthio, isooctylthio, n-nonylthio, n-decylthio, n-undecylthio and n-dodecylthio, methylthio and ethylthio being preferred.

$C_1$–$C_{12}$Mono- or di-alkylamino groups $R_{45}$, $R_{46}$ and $R_{47}$ include, e.g., mono- or di-methylamino, ethylamino, n-propylamino, isopropylamino, n-butylamino, isobutylamino, tert.-butylamino, n-amylamino, n-hexylamino, n-heptylamino, n-octylamino, isooctylamino, n-nonylamino, n-decylamino, n-undecylamino and n-dodecylamino, mono- or di-methylamino or ethylamino being preferred.

The alkyl radicals in the mono-, di-, tri- or tetra-$C_1$–$C_4$alkylammonium groups M are preferably methyl. Mono-, di- or tri-$C_1$–$C_4$hydroxyalkylammonium groups M are preferably those derived from ethanolamine, di-ethanolamine or tri-ethanolamine. When M is ammonium that is di- or tri-substituted by a mixture of $C_1$–$C_4$alkyl and $C_1$–$C_4$hydroxyalkyl groups, it is preferably N-methyl-N-ethanolamine or N,N-dimethyl-N-ethanolamine. M is preferably, however, hydrogen or sodium.

Preferred compounds of formula (23) are those having the formulae:

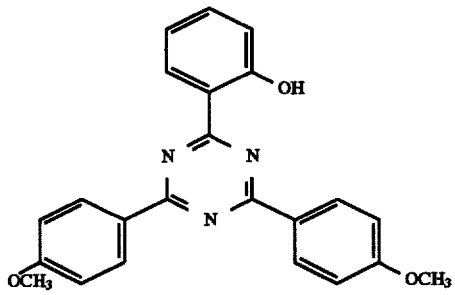

(30)

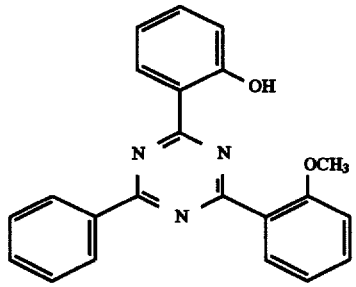

(31)

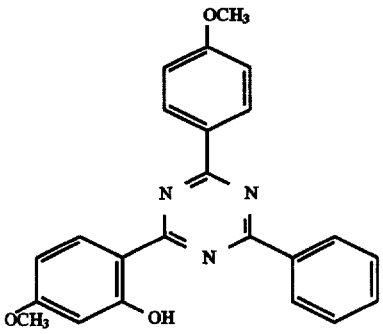

(32)

-continued (33)

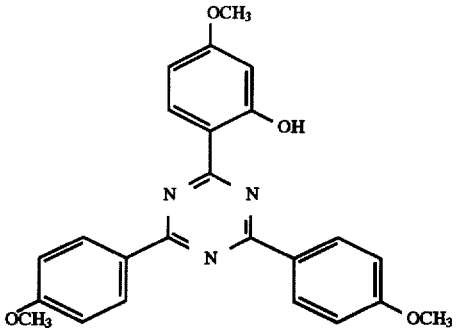

(34)

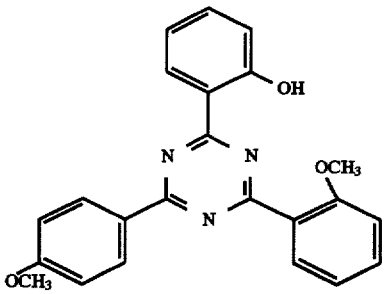

(35)

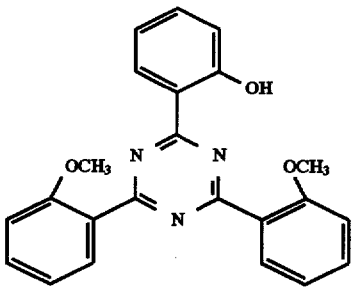

(36)

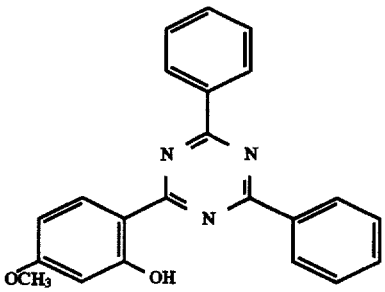

The compounds of formula (23) are known and may be prepared e.g. by the method described in U.S. Pat. No. 3,118,887.

Preferred compounds of formula (24) are those having the formula:

(37)

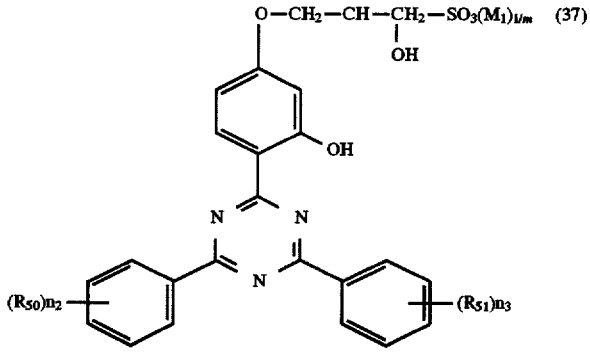

in which $R_{50}$ and $R_{51}$, independently, are $C_1$–$C_{12}$alkyl, preferably methyl; m is 1 or 2; $M_1$ is hydrogen, sodium, potassium, calcium, magnesium, ammonium or tetra-$C_1$–$C_{12}$alkylammonium, preferably hydrogen; and $n_2$ and $n_3$, independently, are 0, 1 or 2, preferably 1 or 2.

Particularly preferred compounds of formula (37) are:

2,4-diphenyl-6-[2-hydroxy-4-(2-hydroxy-3-sulfopropoxy)-phenyl]-1,3,5-triazine;

2-phenyl-4,6-bis-[2-hydroxy-4-(2-hydroxy-3-sulfopropoxy)-phenyl]-1,3,5-triazine;

2,4-bis(2,4-dimethylphenyl)-6-[2-hydroxy-4-(2-hydroxy-3-sulfopropoxy)-phenyl]-1,3,5-triazine; and 2,4-bis(4-methylphenyl)-6-[2-hydroxy-4-(2-hydroxy-3-sulfopropoxy)-phenyl]-1,3,5-triazine.

The compounds of formula (24) are known and may be prepared in the manner, e.g., described in U.S. Pat. No. 5,197,991.

The compounds of formula (27) are known and may be prepared in the manner, e.g., described in U.S. Pat. No. 4,675,352.

The compounds of formula (28) are known and may be prepared in the manner, e.g., described in EP-A-0 314 620.

The compounds of formula (29) are known and may be prepared in the manner, e.g., described in EP-A-0 357 545.

The method of the present invention is advantageously conducted in an aqueous medium in which the relevant fluorescent whitening agent is present in solution or as a fine dispersion.

Although most are readily water-soluble, some of the fluorescent whitening agents or UV absorbers for use in the method according to the present invention may be only sparingly soluble in water and may need to be applied in dispersed or emulsified form. For this purpose, they may be milled with an appropriate dispersant, conveniently using quartz balls and an impeller, down to a particle size of 1–2 microns.

As dispersing agents for such sparingly-soluble compounds there may be mentioned:

acid esters or their salts of alkylene oxide adducts, e.g., acid esters or their salts of a polyadduct of 4 to 40 moles of ethylene oxide with 1 mole of a phenol, or phosphoric acid esters of the adduct of 6 to 30 moles of ethylene oxide with 1 mole of 4-nonylphenol, 1 mole of dinonylphenol or, especially, with 1 mole of compounds which have been produced by the addition of 1 to 3 moles of styrenes on to 1 mole of phenol;

polystyrene sulphonates;

fatty acid taurides;

alkylated diphenyloxide-mono- or -di-sulphonates;

sulphonates of polycarboxylic acid esters;

addition products of 1 to 60, preferably 2 to 30 moles of ethylene oxide and/or propylene oxide on to fatty amines, fatty amides, fatty acids or fatty alcohols, each having 8 to 22 carbon atoms, or on to tri- to hexavalent $C_3$–$C_6$alkanols, the addition products having been converted into an acid ester with an organic dicarboxylic acid or with an inorganic polybasic acid;

lignin sulphonates; and, in particular formaldehyde condensation products, e.g., condensation products of lignin sulphonates and/or phenol and formaldehyde; condensation products of formaldehyde with aromatic sulphonic acids, e.g., condensation products of ditolylethersulphonates and formaldehyde; condensation products of naphthalenesulphonic acid and/or naphthol- or naphthylaminesulphonic acids and formaldehyde; condensation products of phenolsulphonic acids and/or sulphonated dihydroxydiphenylsulphone and phenols or cresols with formaldehyde and/or urea; or condensation products of diphenyloxide-disulphonic acid derivatives with formaldehyde.

Depending on the type of fluorescent whitening agent used, it may be beneficial to carry out the treatment in a neutral, alkaline or acidic bath. The method is usually conducted in the temperature range of from 20° to 140° C., for example at or near to the boiling point of the aqueous bath, e.g. at about 90° C.

Solutions of the fluorescent whitening agent, or its emulsions in organic solvents may also be used in the method of the present invention. For example, the so-called solvent dyeing (pad thermofix application) or exhaust dyeing methods in dyeing machines may be used.

If the method of the present invention is combined with a textile treatment or finishing method, such combined treatment may be advantageously carried out using appropriate stable preparations which contain the fluorescent whitening agent in a concentration such that the desired SPF improvement is achieved.

In certain cases, the fluorescent whitening agent is made fully effective by an after-treatment. This may comprise a chemical treatment such as treatment with an acid, a thermal treatment or a combined thermal/chemical treatment.

It is often advantageous to use the fluorescent whitening agent in admixture with an assistant or extender such as anhydrous sodium sulfate, sodium sulfate decahydrate, sodium chloride, sodium carbonate, an alkali metal phosphate such as sodium or potassium orthophosphate, sodium or potassium pyrophosphate or sodium or potassium tripolyphosphate, or an alkali metal silicate such as sodium silicate.

The preferred fluorescent whitening agent for use in the method according to the present invention will vary depending on the fibre from which the treated fabric is composed.

Thus, for the treatment of cotton fabrics, a fluorescent whitening agent of formula (1), (2), (4), (6) or (9) is preferably used; for polyester fabrics, a fluorescent whitening agent of formula (4), (5), (6), (7), (8), (10), (12), (19) or (20) is preferably used; for the treatment of polyamide, a fluorescent whitening agent of formula (1), (2), (4), (5), (6), (7), (8), (10), (11) or (20) is preferably used; for the treatment of polyacrylonitrile, a fluorescent whitening agent of formula (6), (9), (10), (11), (12) or (21) is preferably used; for wool or silk, a fluorescent whitening agent of formula (1), (2), (4), (6), (9), (10) or (11) is preferably used; and for polypropylene, a fluorescent whitening agent of formula (8) is preferably used.

The use according the present invention, in addition to providing an improvement in the SPF of the treated textile material, also increases the useful life of the textile material so treated, for example by preserving its tear strength and/or its lightfastness.

The present invention is further illustrated by the following Examples.

EXAMPLES 1 to 10

An aqueous textile finishing bath is made up having the composition:

2 g/l acetic acid (40%);

40 g/l Knittex FLC conc. (alkyl-modified dihydroxyethyleneurea/melamine-formaldehyde derivative);

12 g/l Knittex Kat.MO ($MgCl_2$); and 30 g/l Avivan GS (emulsion of fatty acid amides).

To separate samples of this bath are added, in the amounts shown in the following Table one or more of the following active substances (AS):

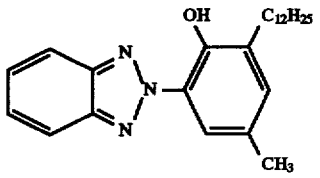

(UVA)

-continued

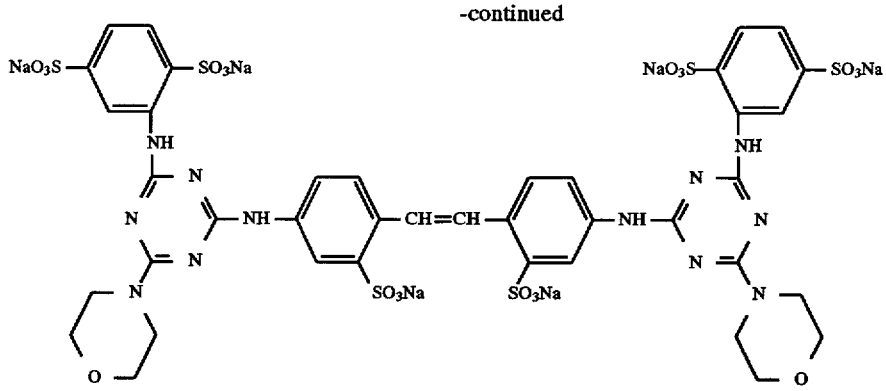

(FWA-1)

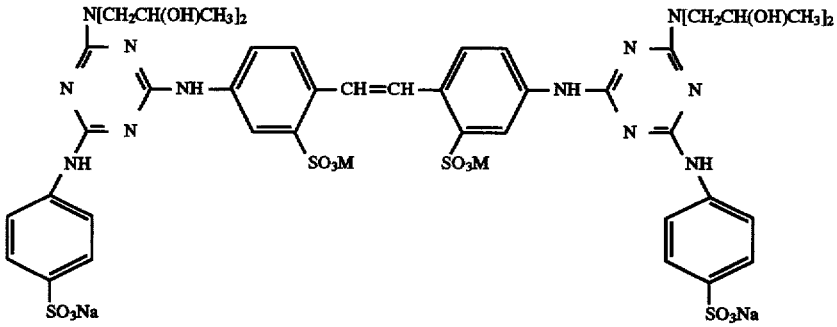

(FWA-2)

Separate samples of bleached, mercerised cotton (density 0.68 g/cm$^3$; thickness 0.20 mm) are then foularded (70 % liquor uptake) with the various finishing baths, at pH 4–5. Drying of the samples of cotton is effected for 3 minutes at 110° C. followed by thermofixing for 4 minutes at 150° C.

The whiteness (GW) of the treated samples is measured with a DCI/SF 500 spectrophotometer according to the Ganz method. The Ganz method is described in detail in the Ciba-Geigy Review, 1973/1, and also in the article "Whiteness Measurement", ISCC Conference on Fluorescence and the Colorimetry of Fluorescent Materials, Williamsburg, February 1972, published in the Journal of Color and Appearance, 1, No. 5 (1972).

The Sun Protection Factor (SPF) is determined by measurement of the UV light transmitted through the swatch, using a double grating spectrophotometer fitted with an Ulbricht bowl. Calculation of SPF is conducted as described by B. L. Diffey and J. Robson in J. Soc. Cosm. Chem. 40 (1989), pp. 130–131.

The results are shown in the following Table.

TABLE

| Example | AS | Concentration of AS g/l in bath | Concentration of AS % on substrate | GW | SPF |
|---|---|---|---|---|---|
| — | — | — | — | 62 | 1.9 |
| — | UVA | 10 | 0.35 | 57 | 11.2 |
| — | UVA | 20 | 0.70 | 53 | 17.3 |
| — | UVA | 30 | 1.05 | 34 | 17.4 |
| 1 | UVA | 10 | 0.35 | 175 | 15.8 |
| | FWA-1 | 10 | 0.13 | | |
| 2 | UVA | 20 | 0.70 | 171 | 16.5 |
| | FWA-1 | 10 | 0.13 | | |
| 3 | UVA | 10 | 0.35 | | |
| | FWA-1 | 20 | 0.25 | 177 | 18.0 |
| 4 | UVA | 10 | 0.35 | | |
| | FWA-2 | 8 | 0.14 | 167 | 18.3 |
| 5 | UVA | 20 | 0.70 | 134 | 21.7 |
| | FWA-2 | 8 | 0.14 | | |
| 6 | UVA | 10 | 0.35 | | |

TABLE-continued

| Example | AS | Concentration of AS g/l in bath | Concentration of AS % on substrate | GW | SPF |
|---|---|---|---|---|---|
| | FWA-2 | 16 | 0.28 | 178 | 15.9 |
| 7 | FWA-1 | 10 | 0.13 | 227 | 11.7 |
| 8 | FWA-1 | 20 | 0.25 | 229 | 15.2 |
| 9 | FWA-2 | 8 | 0.14 | 223 | 13.0 |
| 10 | FWA-2 | 16 | 0.28 | 215 | 13.2 |

The results in the Table demonstrate clearly the improvement in the SPF value of a substrate according to the method of the present invention.

EXAMPLES 11 to 20

Using the general procedure described in Examples 1 to 10, samples of poplin ("Supraluxe" ex Walser AG; density 0.62 g/cm$^3$; thickness 0.17 mm) are foularded (70 % liquor uptake) with the various finishing baths, at pH 4–5. Drying of the samples of poplin is effected for 3 minutes at 110° C. followed by thermofixing for 4 minutes at 150° C.

The whiteness (GW) and SPF of the respective treated samples are measured as before.

In order to evaluate the wash permanency of the textile treatment applied, the respective treated poplin samples are washed ten times and the whiteness (GW) and SPF values are determined after the first, fifth and tenth washes.

50g of the poplin swatches are washed in 1 litre of tap water (12° German hardness) containing $^4$g of a detergent having the following composition (weight %):

| | |
|---|---|
| 8.0% | Sodium alkylbenzene sulfonate |
| 2.9% | Tallow alcohol-tetradecane-ethylene glycol ether (14 mols EO) |
| 3.5% | Sodium soap |
| 43.8% | Sodium tripolyphosphate |

-continued

| | |
|---|---|
| 7.5% | Sodium silicate |
| 1.9% | Magnesium silicate |
| 1.2% | Carboxymethyl cellulose |
| 0.2% | EDTA |
| 21.2% | Sodium sulfate |
| x% | fluorescent whitening agent (FWA) by weight on detergent |
| | Water to 100%. |

The washing is conducted at 60° C. over 15 minutes. The swatches are then rinsed under cold running tap water for 30 seconds and dried.

The results are set out in the following Table.

| | | Concentration of AS | | GW after washing | | | | SPF after washing | | | |
|---|---|---|---|---|---|---|---|---|---|---|---|
| Ex. | AS | g/l in bath | % on sub. | 0x | 1x | 5x | 10x | 0x | 1x | 5x | 10x |
| — | — | — | — | 63 | 71 | 75 | 76 | 4 | 5 | 5 | 5 |
| — | UVA | 10 | 0.35 | 59 | 70 | 69 | 72 | 25 | 18 | 13 | 11 |
| — | UVA | 20 | 0.70 | 55 | 67 | 68 | 71 | 47 | 31 | 30 | 19 |
| — | UVA | 30 | 1.05 | 58 | 68 | 72 | 72 | 81 | 45 | 47 | 30 |
| — | UVA | 40 | 1.40 | 52 | 65 | 70 | 70 | 99 | 46 | 50 | 37 |
| 11 | UVA | 10 | 0.35 | 176 | 152 | 133 | 133 | 57 | 19 | 13 | 10 |
| | FWA-1 | 10 | 0.13 | | | | | | | | |
| 12 | UVA | 20 | 0.70 | 147 | 123 | 109 | 108 | 67 | 39 | 24 | 16 |
| | FWA-1 | 10 | 0.13 | | | | | | | | |
| 13 | UVA | 10 | 0.35 | 203 | 193 | 160 | 155 | 51 | 19 | 13 | 13 |
| | FWA-1 | 20 | 0.25 | | | | | | | | |
| 14 | UVA | 10 | 0.35 | 178 | 178 | 171 | 166 | 41 | 26 | 17 | 19 |
| | FWA-2 | 8 | 0.14 | | | | | | | | |
| 15 | UVA | 20 | 0.70 | 149 | 141 | 138 | 136 | 82 | 62 | 34 | 29 |
| | FWA-2 | 8 | 0.14 | | | | | | | | |
| 16 | UVA | 10 | 0.35 | 198 | 210 | 208 | 208 | 59 | 26 | 16 | 18 |
| | FWA-2 | 16 | 0.28 | | | | | | | | |
| 17 | FWA-1 | 10 | 0.13 | 222 | 205 | 197 | 178 | 24 | 9 | 8 | 7 |
| 18 | FWA-1 | 20 | 0.25 | 236 | 227 | 203 | 209 | 31 | 13 | 6 | 7 |
| 19 | FWA-2 | 8 | 0.14 | 216 | 215 | 216 | 206 | 31 | 19 | 16 | 10 |
| 20 | FWA-2 | 16 | 0.28 | 226 | 239 | 233 | 235 | 42 | 19 | 13 | 16 |

The results in the Table demonstrate clearly the improvement in the SPF value of a substrate treated according to the method of the present invention and, moreover, the use of a combination of UVA and FWA leads to unexpected synergistic SPF values.

EXAMPLE 21

A 5 g. sample of poplin ("Supraluxe" ex Walser AG; density 0.62 g/cm$^3$) is foularded (80% liquor uptake) with an aqueous bath containing:

4 g/l sodium bicarbonate and 12.5 g/l of a fluorescent whitening agent having the formula:

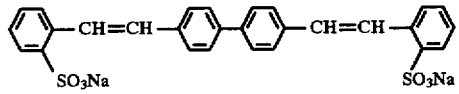

(FWA-3)

to provide a concentration of 1% by weight of active substance on the poplin substrate.

Foularding is conducted at alkaline pH.

Drying of the treated sample is carried out at 80° C. for 2 minutes.

The treated poplin has an SPF rating of above 40, whereas that of the untreated poplin is 4.

EXAMPLE 22

A 5 g. sample of poplin ("Supraluxe" ex Walser AG; density 0.62 g/cm$^3$) is foularded (80% liquor uptake) with an aqueous bath containing:

2 g/l acetic acid (40%)

40 g/l Knittex FLC (conc.)

12 g/l Knittex Kat. MO 30 g/L Avivan GS and 12.5 g/l of a fluorescent whitening agent having the formula:

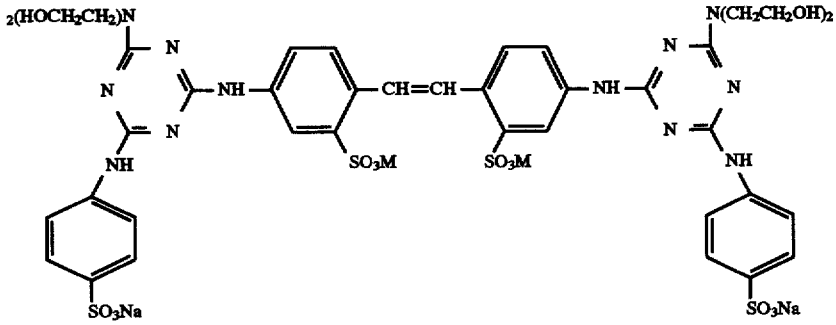

(FWA-4)

to provide a concentration of 1% by weight of active substance on the poplin substrate.

Foularding is conducted at a pH of 6–7.

Drying of the treated sample is carried out at 80° C. for 2 minutes, followed by thermofixing for 4 minutes at 150° C.

The treated poplin has an SPF rating of above 30, whereas that of the untreated poplin is 4.

EXAMPLE 23

A 5 g. sample of poplin ("Supraluxe" ex Walser AG; density 0.62 g/cm$^3$) is treated with an aqueous bath containing:

3 g/l anhydrous Glaubers Salt 3 g/l caustic soda flake 1.5 g/l Invadine JU (nonylphenol ethoxylate) and 1% by weight of poplin fabric of a fluorescent whitening agent having the formula:

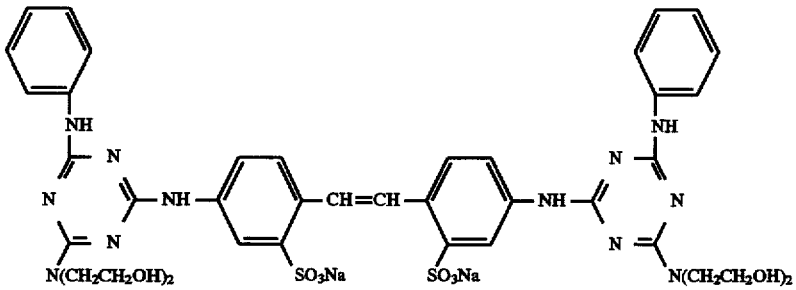

(FWA-5)

the treatment is conducted at 95° C. over 30 minutes and at a liquor ratio of 40:1, using a laboratory dyeing machine.

The treated poplin is rinsed successively with hot or cold water and dried.

The treated poplin has an SPF rating of above 30, whereas that of the untreated poplin is 4.

We claim:

1. A method of improving the sun protection factor (SPF) of textile fibre material, comprising treating the textile fibre material in an essentially aqueous medium with an aqueous solution or fine dispersion comprising an effective amount of 0.01 to 3% based on the weight of the textile fibre material of at least one fluorescent whitening agent which is a 4,4'-bis-(triazinylamino)-stilbene-2,2'-disulfonic acid, 4,4'-bis-(triazol-2-yl)stilbene-2,2'-disulfonic acid, 4,4'-(diphenyl)-stilbene, 4,4'-distyryl-biphenyl, 4-phenyl-4'-benzoxazolyl-stilbene, stilbenyl-naphthotriazole, 4-styryl-stilbene, bis-(benzoxazol-2-yl), bis-(benzimidazol-2-yl), coumarin, pyrazoline, naphthalimide, triazinyl-pyrene, 2-styryl-benzoxazole- or -naphthoxazole, benzimidazole-benzofuran or oxanilide.

2. A method according to claim 1 in which the textile fibre material treated is composed of wool, polyamide, cotton, polyester, polyacrylic, silk, polypropylene or a mixture thereof.

3. A method according to claim 2 in which the textile fibre material is in the form of endless filaments (stretched or unstretched), staple fibres, flocks, hanks, textile filament yarns, threads, nonwovens, felts, waddings, flocked structures or woven textile or bonded textile fabrics or knitted fabrics.

4. A method according to claim 1 in which the amount of fluorescent whitening agent present in the composition ranges from 0.05 to 1%, based on the weight of the textile fibre material.

5. A method according to claim 1 in which the 4,4'-bis-(triazinylamino)-stilbene-2,2'-disulfonic acid is one having the formula:

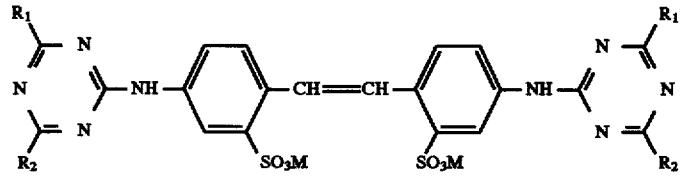

(1)

in which $R_1$ and $R_2$, independently, are phenyl, mono- or disulfonated phenyl, phenylamino, mono- or disulfonated phenylamino, morpholino, —$N(CH_2CH(OH)CH_3)_2$, —$N(CH_2CH_2OH)_2$, —$N(CH_3)(CH_2CH_2OH)$, —$NH_2$, —$N(C_1$–$C_4$-alkyl$)_2$, —$OCH_3$, —Cl, —NH—$CH_2CH_2SO_3H$ or —NH—$CH_2CH_2OH$; and M is H, Na, K, Ca, Mg, ammonium, mono-, di-, tri- or tetra-$C_1$–$C_4$-alkylammonium, mono-, di- or tri-$C_1$–$C_4$-hydroxyalkylammonium or ammonium that is di- or tri-substituted by a mixture of $C_1$–$C_4$-alkyl and $C_1$–$C_4$-hydroxyalkyl groups.

6. A method according to claim 5 in which the compound of formula (1) is one in which each $R_1$ is 2,5-disulfophenyl and each $R_2$ is morpholino; or each $R_1$ is 2,5-disulfophenyl and each $R_2$ is $N(C_2H_5)_2$; or each $R_1$ is 3-sulfophenyl and each $R_2$ is $NH(CH_2CH_2OH)$ or $N(CH_2CH_2OH)_2$; or each $R_1$ is 4-sulfophenyl and each $R_2$ is —$N(CH_2CH(OH)CH_3)_2$ or $N(CH_2CH_2OH)_2$; and, in each case, the sulfo group is $SO_3M$ in which M is sodium.

7. A method according to claim 1 in which the 4,4'-bis-(triazol-2-yl)stilbene-2,2'-disulfonic acid is one having the formula:

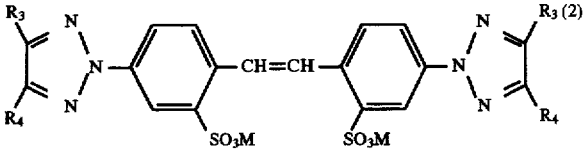

in which $R_3$ and $R_4$, independently, are H, $C_1$–$C_4$-alkyl, phenyl or monosulfonated phenyl; and M is H, Na, K, Ca, Mg, ammonium, mono-, di-, tri- or tetra-$C_1$–$C_4$-alkylammonium, mono-, di- or tri-$C_1$–$C_4$-hydroxyalkylammonium or ammonium that is di- or tri-substituted by a mixture of $C_1$–$C_4$-alkyl and $C_1$–$C_4$-hydroxyalkyl groups.

8. A method according to claim 7 in which the compound of formula (2) is one in which $R_3$ is phenyl, $R_4$ is H and M is sodium.

9. A method according to claim 1 in which the 4,4'-(diphenyl)-stilbene is one having the formula:

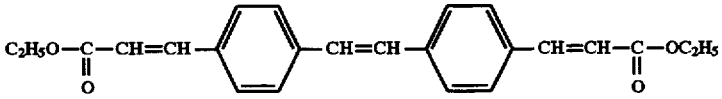

(3)

10. A method according to claim 1 in which the 4,4'-distyryl-biphenyl used has the formula:

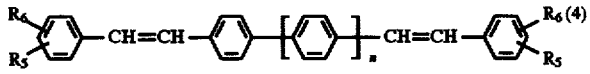

in which $R_5$ and $R_6$, independently, are H, $SO_3M$, $SO_2N(C_1$–$C_4$-alkyl$)_2$, O—($C_1$–$C_4$-alkyl), CN, Cl, $COO(C_1$–$C_4$-alkyl), $CON(C_1$–$C_4$-alkyl$)_2$ or $O(CH_2)_3N^{\oplus}(CH_3)_2An^{\ominus}$ in which $An^{\ominus}$ is an anion of an organic or inorganic acid; and n is 0 or 1.

11. A method according to claim 10 in which $An^{\ominus}$ is a formate, acetate, propionate, glcolate, lactate, acrylate, methanephosphonate, phosphite, dimethyl or diethyl phosphite anion, or a mixture thereof.

12. A method according to claim 11 in which the compound of formula (4) is one in which n is 1, each $R_5$ is a 2-$SO_3M$ group in which M is sodium and each $R_6$ is H; or each $R_5$ is $O(CH_2)_3N^{\oplus}(CH_3)_2An^{\ominus}$ in which $An^{\ominus}$ is acetate.

13. A method according to claim 1 in which the 4-phenyl-4'-benzoxazolyl-stilbene has the formula:

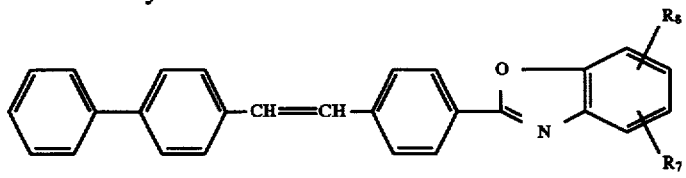

(5)

in which $R_7$ and $R_8$, independently, are H, Cl, $C_1$–$C_4$-alkyl or $SO_2$—$C_1$–$C_4$-alkyl.

14. A method according to claim 13 in which the compound of formula (5) is one in which $R_7$ is 4-$CH_3$ and $R_8$ is 2-$CH_3$.

15. A method according to claim 1 in which a stilbenyl-naphthotriazole used is one of formula:

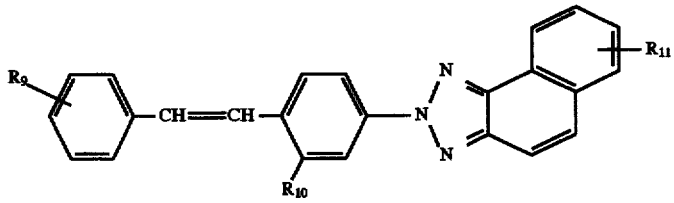

(6)

in which $R_9$ is H or Cl; $R_{10}$ is $SO_3M$, $SO_2N(C_1$–$C_4$-alkyl$)_2$, $SO_2O$-phenyl or CN; $R_{11}$ is H or $SO_3M$; and M is H, Na, K, Ca, Mg, ammonium, mono-, di-, tri- or tetra-$C_1$–$C_4$-alkylammonium, mono-, di- or tri-$C_1$–$C_4$-hydroxyalkylammonium or ammonium that is di- or tri-substituted by a mixture of $C_1$–$C_4$-alkyl and $C_1$–$C_4$-hydroxyalkyl groups.

16. A method according to claim 15 in which the compound of formula (6) is one in which $R_9$ and $R_{11}$ are H and $R_{10}$ is 2-$SO_3M$ in which M is Na.

17. A method according to claim 1 in which a 4-styryl-stilbene used is one of formula:

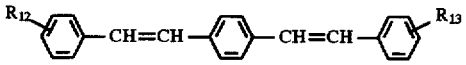

(7)

in which $R_{12}$ and $R_{13}$, independently, are H, $SO_3M$, $SO_2N(C_1-C_4\text{-alkyl})_2$, O—($C_1$–$C_4$-alkyl), CN, Cl, $COO(C_1-C_4\text{-alkyl})$, $CON(C_1-C_4\text{-alkyl})_2$ or $O(CH_2)_3N^{\oplus}(CH_3)_2An^{\ominus}$ in which $An^{\ominus}$ is an anion of an organic or inorganic acid.

18. A method according to claim 17 in which a compound of formula (7) is used in which each of $R_{12}$ and $R_{13}$ is 2-cyano, 2-$SO_3M$ in which M is sodium or $O(CH_2)_3N^{\oplus}(CH_3)_2An^{\ominus}$ in which $An^{\ominus}$ is acetate.

19. A method according to claim 1 in which a bis-(benzoxazol-2-yl) derivative used is one of formula:

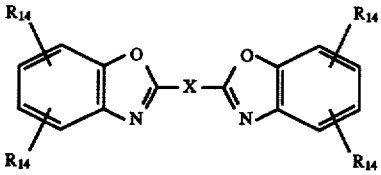

(8)

in which $R_{14}$, independently, is H, $C(CH_3)_3$, $C(CH_3)_2$-phenyl, $C_1$–$C_4$-alkyl or COO—$C_1$–$C_4$-alkyl, and X is —CH=CH— or a group of formula:

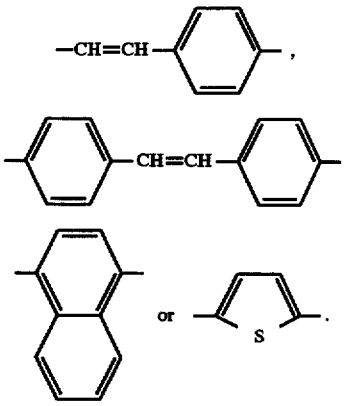

20. A method according to claim 17 in which a compound of formula (8) used is one in which each $R_{14}$ is H and X is

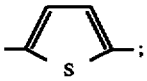

or one group $R_{14}$ in each ring is 2-methyl and the other $R_{14}$ is H and X is —CH=CH—; or one group $R_{14}$ in each ring is 2-$C(CH_3)_3$ and the other $R_{14}$ is H and X is

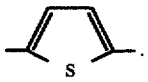

21. A method according to claim 1 in which a bis-(benzimidazol-2-yl) is used of formula:

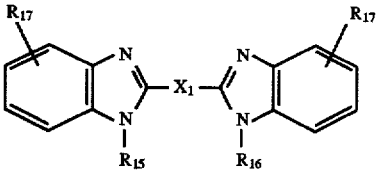

(9)

in which $R_{15}$ and $R_{16}$, independently, are H, $C_1$–$C_4$-alkyl or $CH_2CH_2OH$, $R_{17}$ is H or $SO_3M$; $X_1$ is —CH=CH— or a group of formula:

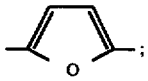

and M is H, Na, K, Ca, Mg, ammonium, mono-, di-, tri- or tetra-$C_1$–$C_4$-alkylammonium, mono-, di- or tri-$C_1$–$C_4$-hydroxyalkylammonium or ammonium that is di- or tri-substituted by a mixture of $C_1$–$C_4$-alkyl and $C_1$–$C_4$-hydroxyalkyl groups.

22. A method according to claim 21 in which a compound of formula (9) used is one in which $R_{15}$ and $R_{16}$ are each H, $R_{17}$ is $SO_3M$ in which M is sodium and $X_1$ is —CH=CH—.

23. A method according to claim 1 in which a coumarin is used of formula:

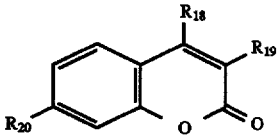

(10)

in which $R_{18}$ is H, Cl or $CH_2COOH$, $R_{19}$ is H, phenyl, COO—$C_1$–$C_4$-alkyl or a group of formula:

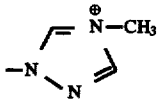

and $R_{20}$ is O—$C_1$–$C_4$-alkyl, $N(C_1-C_4\text{-alkyl})_2$, NH—CO—$C_1$–$C_4$-alkyl or a group of formula:

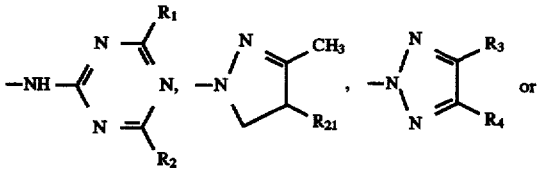

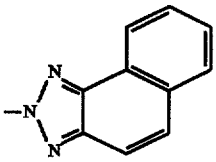

in which $R_1$ and $R_2$ are, independently, phenyl, mono- or disulfonated phenyl, phenylamino, mono- or disulfonated phenylamino, morpholino, $—N(CH_2CH_2OH)_2$, $—N(CH_3)(CH_2CH_2OH)$, $—NH_2$, $—N(C_1-C_4\text{-alkyl})_2$, $—OCH_3$, —Cl, $—NH—CH_2CH_2SO_3H$ or $—NH—CH_2CH_2OH$, $R_3$ and $R_4$ are, independently, H, $C_1$–$C_4$-alkyl, phenyl or monosulfonated phenyl and $R_{21}$ is H, $C_1$–$C_4$-alkyl or phenyl.

24. A method according to claim 23 in which a compound of formula (10) is used which has the formula:

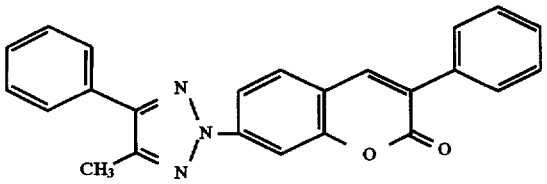

(11)

or

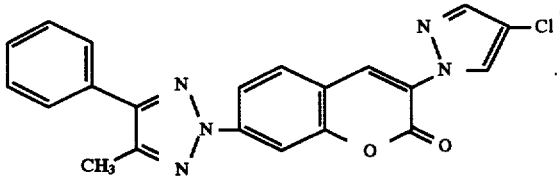

(12)

25. A method according to claim 1 in which the pyrazoline used is one having the formula:

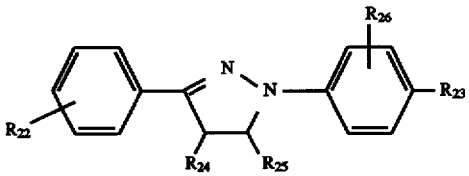

(13)

in which $R_{22}$ is H, Cl or $N(C_1-C_4\text{-alkyl})_2$, $R_{23}$ is H, Cl, $SO_3M$, $SO_2NH_2$, $SO_2NH—(C_1-C_4\text{-alkyl})$, $COO—C_1-C_4$-alkyl, $SO_2—C_1-C_4$-alkyl, $SO_2NHCH_2CH_2CH_2N^{\oplus}(CH_3)_3An^{\oplus}$ or $SO_2CH_2CH_2N^{\oplus}H(C_1-C_4\text{-alkyl})_2An^{\ominus}$, $R_{24}$ and $R_{25}$ are the same or different and each is H, $C_1-C_4$-alkyl or phenyl and $R_{26}$ is H or Cl, $An^{\oplus}$ is an anion of an organic or inorganic acid and M is H, Na, K, Ca, Mg, ammonium, mono-, di-, tri- or tetra-$C_1-C_4$-alkylammonium, mono-, di- or tri-$C_1-C_4$-hydroxyalkylammonium or ammonium that is di- or tri-substituted by a mixture of $C_{1-C4}$-alkyl and $C_1-C_4$-hydroxyalkyl groups.

26. A method according to claim 25 in which a compound of formula (11) used is one in which $R_{22}$ is Cl, $R_{23}$ is $SO_2CH_2CH_2N^{\oplus}H(C_1-C_4\text{-alkyl})_2\ An^{\ominus}$ in which $An^{\ominus}$ is phosphite and $R_{24}$, $R_{25}$ and $R_{26}$ are each H; or those having one of the formulae:

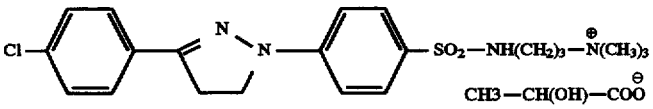

(14)

or

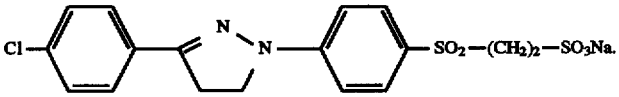

(15)

27. A method according to claim 1 in which a naphthalimide is used of formula:

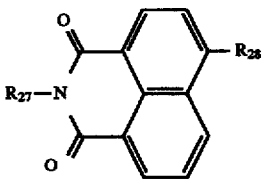

(16)

in which $R_{27}$ is $C_1-C_4$-alkyl or $CH_2CH_2CH_2N^{\oplus}(CH_3)_3$; $R_{28}$ is $O—C_1-C_4$-alkyl, $SO_3M$ or $NH—CO—C_1-C_4$-alkyl; and M is H, Na, K, Ca, Mg, ammonium, mono-, di-, tri- or tetra-$C_1-C_4$alkyl-ammonium, mono-, di- or tri-$C_1-C_4$-hydroxyalkylammonium or ammonium that is di- or tri-substituted by a mixture of $C_1-C_4$-alkyl and $C_1-C_4$-hydroxyalkyl groups.

28. A method according to claim 1 in which a naphthalimide is used having one of the formulae:

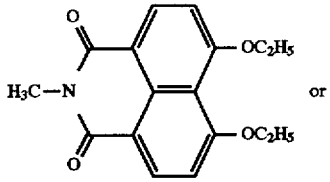

(17)

or

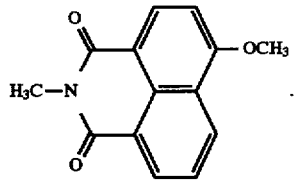

(18)

29. A method according to claim 1 in which a triazinylpyrene is used of formula:

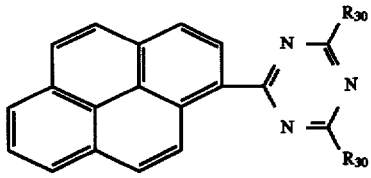

(19)

in which each $R_{30}$, independently, is $C_1-C_4$-alkoxy.

30. A method according to claim 29 in which a compound of formula (13) is used in which each $R_{30}$ is methyl.

31. A method according to claim 1 in which a 2-styrylbenzoxazole- or -naphthoxazole derivative is used having the formula:

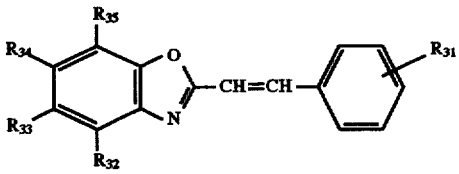

(20)

in which $R_{31}$ is CN, Cl, $COO—C_1-C_4$-alkyl or phenyl; $R_{32}$ and $R_{33}$ are the atoms required to form a fused benzene ring or $R_{33}$ and $R_{35}$, independently, are H or $C_1-C_4$-alkyl; and $R_{34}$ is H, $C_1-C_4$-alkyl or phenyl.

32. A method according to claim 31 in which a compound of formula (20) is used in which $R_{31}$ is a 4-phenyl group and each of $R_{32}$ to $R_{35}$ is H.

33. A method according to claim 1 in which a benzimidazole-benzofuran is used having the formula:

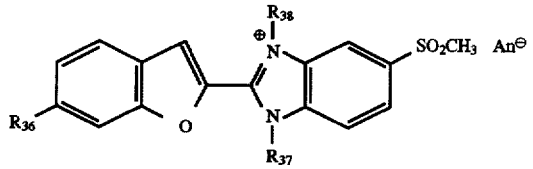

(21)

in which $R_{36}$ is $C_1$–$C_4$-alkoxy; $R_{37}$ and $R_{38}$, independently, are $C_1$–$C_4$-alkyl; and $An^{\ominus}$ is an anion of an organic or inorganic acid.

34. A method according to claim 33 in which a compound of formula (21) is used in which $R_{36}$ is methoxy, $R_{37}$ and $R_{38}$ are each methyl and $An^{\ominus}$ is methane sulfonate.

35. A method according to claim 1 in which an oxanilide is used having the formula:

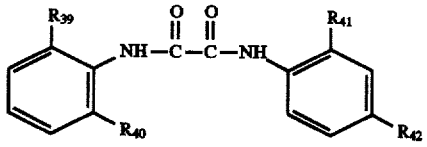

(22)

in which $R_{39}$ is $C_1$–$C_4$alkoxy, $R_{41}$ is $C_1$–$C_4$alkyl, $C_1$–$C_4$alkyl-$SO_3M$ or $C_1$–$C_4$alkoxy-$SO_3M$ and $R_{40}$ and $R_{42}$ are the same and each is hydrogen, tert. butyl or $SO_3M$ in which M is H, Na, K, Ca, Mg, ammonium, mono-, di-, tri- or tetra-$C_1$–$C_4$-alkylammonium, mono-, di- or tri-$C_1$–$C_4$-hydroxyalkylammonium or ammonium that is di- or tri-substituted by a mixture of $C_1$–$C_4$-alkyl and $C_1$–$C_4$-hydroxyalkyl groups.

36. A method according to claim 1 in which the fluorescent whitening agent is used:

a) in mixtures with dyes (shading) or pigments;

b) in mixtures with carriers, wetting agents, antioxidants, UV absorbers and/or chemical bleaching agents; or c) in admixture with crosslinking or finishing agents or in combination with a textile finishing process or flameproof finish, soft handle finish, antisoiling finish, antistatic finish or antimicrobial finish.

37. A method according to claim 36 in which the fluorescent whitening agent is used together with a UV absorber.

38. A method according to claim 37 in which the UV absorber is an oxalic anilide, an o-hydroxybenzophenone, an o-hydroxyaryl-1,3,5-triazine, a sulphonated-1,3,5-triazine, an o-hydroxyphenylbenzotriazole, a 2-aryl-2H-benzotriazole, a salicylic acid ester, a substituted acrylonitrile, a substituted arylaminoethylene or a nitrilohydrazone.

39. A method according to claim 38 in which the UV absorber is a benzotriazine or benzotriazole.

40. A method according to claim 39 in which the triazine UV absorber is one having the formula:

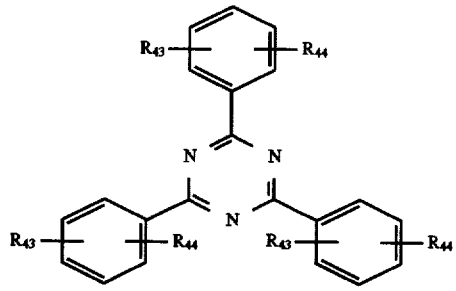

(23)

in which $R_{43}$ and $R_{44}$, independently, are hydrogen, hydroxy or $C_1$–$C_5$alkoxy.

41. A method according to claim 40 in which the compound of formula (23) has one of the the formulae:

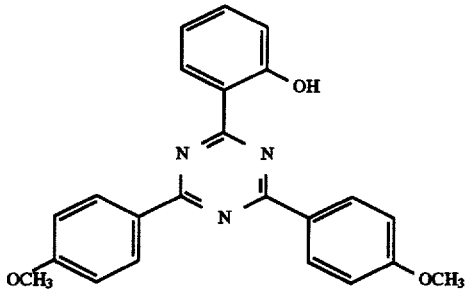

(30)

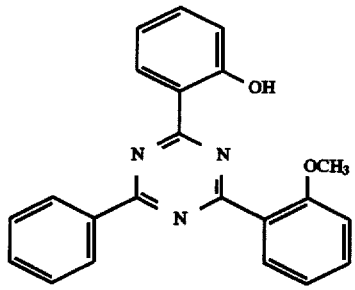

(31)

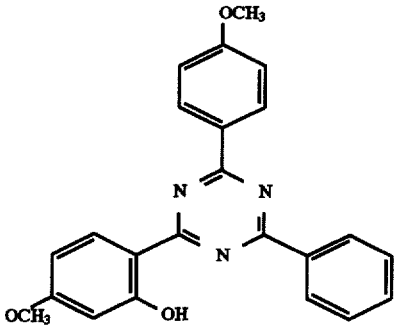

(32)

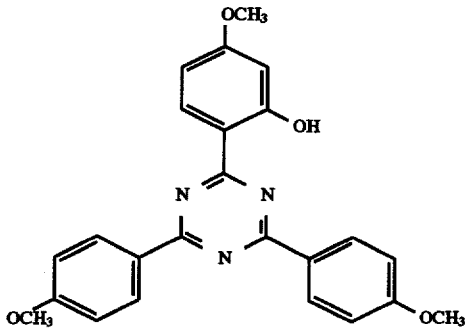

(33)

-continued (34)

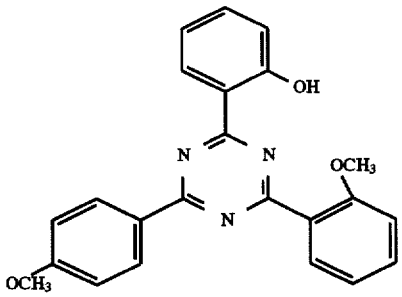

(35)

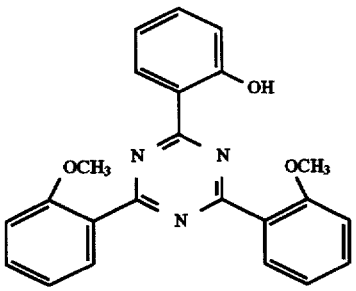

and (36)

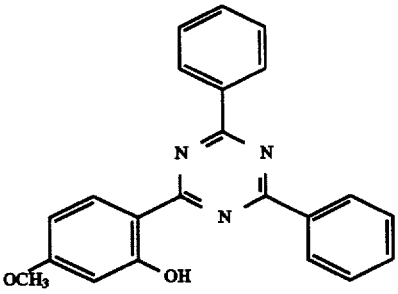

42. A method according to claim 40 in which the triazine UV absorber is one having the formula:

(24)

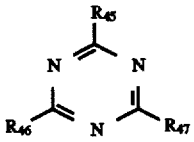

in which at least one of $R_{45}$, $R_{46}$ and $R_{47}$ is a radical of formula:

(25)

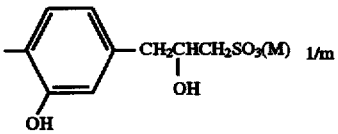

in which M is H, Na, K, Ca, Mg, ammonium, mono-, di-, tri- or tetra-$C_1$–$C_4$-alkylammonium, mono-, di- or tri-$C_1$–$C_4$-hydroxyalkylammonium or ammonium that is di- or tri-substituted by a mixture of $C_1$–$C_4$-alkyl and $C_1$–$C_4$-hydroxyalkyl goups; m is 1 or 2; and the remaining substituent(s) $R_{45}$, $R_{46}$ and $R_{47}$ are, independently, amino, $C_1$–$C_{12}$alkyl, $C_1$–$C_{12}$alkoxy, $C_1$–$C_{12}$alkylthio, mono- or di-$C_1$–$C_{12}$alkylamino, phenyl, phenylthio, anilino or N-phenyl-N—$C_1$–$C_4$-alkylamino, the respective phenyl substituents being optionally substituted by $C_1$–$C_{12}$alkyl or -alkoxy, $C_5$–$C_8$cycloalkyl or halogen.

43. A method according to claim 42 in which the compound of formula (23) is one having the formula:

(37)

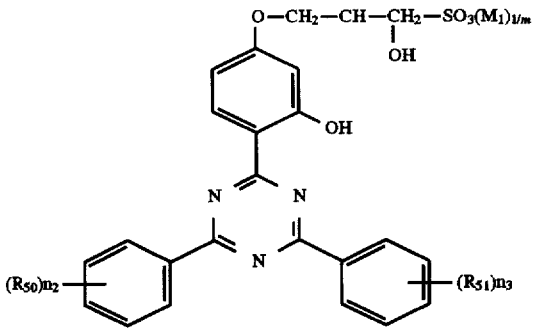

in which $R_{50}$ and $R_{51}$, independently, are $C_1$–$C_{12}$alkyl; m is 1 or 2; $M_1$ is hydrogen, sodium, potassium, calcium, magnesium, ammonium or tetra-$C_1$–$C_{12}$alkylammonium; and $n_2$ and $n_3$, independently, are 0, 1 or 2.

44. A method according to claim 43 in which $R_{50}$ and $R_{51}$, independently, are methyl; $M_1$ is hydrogen; and $n_2$ and $n_3$, independently, are 1 or 2.

45. A method according to claim 38 in which the triazine UV absorber is one having the formula:

(26)

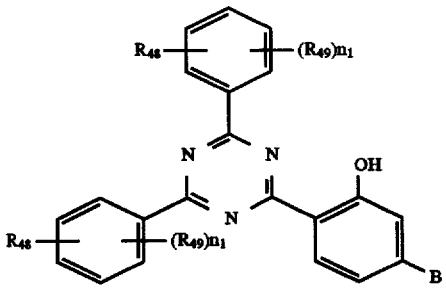

in which $R_{48}$ is hydrogen or hydroxy; $R_{49}$, independently, are hydrogen or $C_1$–$C_4$alkyl; $n_1$ is 1 or 2; and B is a group of formula:

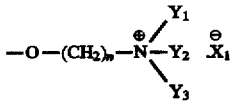

in which n is an integer from 2 to 6; $Y_1$ and $Y_2$, independently, are $C_1$–$C_4$alkyl optionally substituted by halogen, cyano, hydroxy or $C_1$–$C_4$alkoxy or $Y_1$ and $Y_2$, together with the nitrogen atom to which they are each attached, form a 5–7 membered heterocyclic ring; $Y_3$ is hydrogen, $C_3$–$C_4$alkenyl or $C_1$–$C_4$alkyl optionally substituted by cyano, hydroxy or $C_1$–$C_4$alkoxy or $Y_1$, $Y_2$ and $Y_3$, together with the nitrogen atom to which they are each attached, form a pyridine or picoline ring; and $X_1^{\ominus}$ is a colourless anion.

46. A method according to claim 45 in which n is 2 or 3 and $X_1^{\ominus}$ is $CH_3OSO_3^{\ominus}$ or $C_2H_5OSO_3^{\ominus}$.

47. A method according to claim 38 in which the benzotriazole UV absorber is one having the formula:

(27)

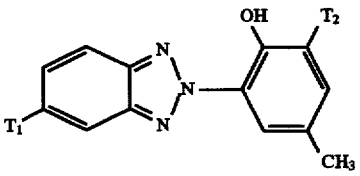

in which $T_1$ is chlorine or hydrogen; and $T_2$ is a random statistical mixture of at least three isomeric branched sec.

$C_8$–$C_{30}$alkyl groups, each having the formula —$CH(E_1)(E_2)$ in which $E_1$ is a straight chain $C_1$–$C_4$alkyl group and $E_2$ is a straight chain $C_4$–$C_{15}$alkyl group, the total number of carbon atoms in $E_1$ and $E_2$ being from 7 to 29.

48. A method according to claim 47 in which $T_1$ is hydrogen; and $T_2$ is a random statistical mixture of at least three isomeric branched sec. $C_9$–$C_{12}$alkyl groups, each having the formula —$CH(E_1)(E_2)$ in which $E_1$ is a straight chain $C_1$–$C_4$alkyl group and $E_2$ is a straight chain $C_4$–$C_{15}$alkyl group, the total number of carbon atoms in $E_1$ and $E_2$ being from 7 to 29.

49. A method according to claim 38 in which the benzotriazole UV absorber is one having the formula:

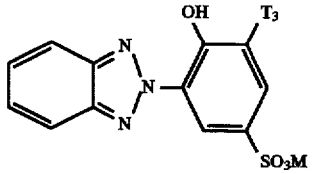

(28)

in which M is H, Na, K, Ca, Mg, ammonium, mono-, di-, tri- or tetra-$C_1$–$C_4$-alkylammonium, mono-, di- or tri-$C_1$–$C_4$-hydroxyalkylammonium or ammonium that is di- or tri-substituted by a mixture of $C_1$–$C_4$-alkyl and $C_1$–$C_4$-hydroxyalkyl groups and $T_3$ is hydrogen, $C_1$–$C_{12}$alkyl or benzyl.

50. A method according to claim 38 in which the benzotriazole UV absorber is one having the formula:

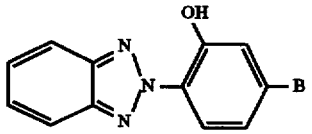

(29)

in which B is a group of formula:

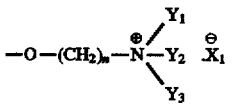

in which n is an integer from 2 to 6; $Y_1$ and $Y_2$, independently, are $C_1$–$C_4$alkyl optionally substituted by halogen, cyano, hydroxy or $C_1$–$C_4$alkoxy or $Y_1$ and $Y_2$, together with the nitrogen atom to which they are each attached, form a 5–7 membered heterocyclic ring; $Y_3$ is hydrogen, $C_3$–$C_4$alkenyl or $C_1$–$C_4$alkyl optionally substituted by cyano, hydroxy or $C_1$–$C_4$alkoxy or $Y_1$, $Y_2$ and $Y_3$, together with the nitrogen atom to which they are each attached, form a pyridine or picoline ring.

51. A method according to claim 1 in which the treatment is conducted in a neutral, alkaline or acidic bath.

52. A method according to claim 1 in which the treatment is conducted in the temperature range of from 20° to 140° C.

53. A method according to claim 1 in which the fluorescent whitening agent is made fully effective by an after-treatment with a chemical, a thermal treatment or a combined thermal/chemical treatment.

54. A method according to claim 1 in which, for the treatment of cotton fabrics, a fluorescent whitening agent of formula:

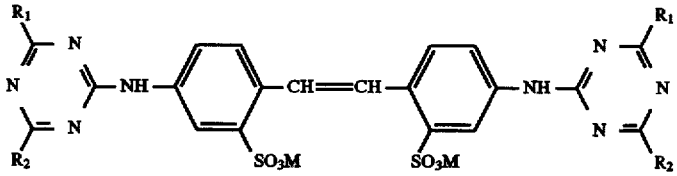

(1)

in which $R_1$ and $R_2$, independently, are phenyl, mono- or disulfonated phenyl, phenylamino, mono- or disulfonated phenylamino, morpholino, —$N(CH_2CH_2OH)_2$, —$N(CH_3)(CH_2CH_2OH)$, —$NH_2$, —$N(C_1$–$C_4)_2$, —$OCH_3$, —Cl, —NH—$CH_2CH_2SO_3H$ or —NH—$CH_2CH_2OH$; and M is H, Na, K, Ca, Mg, ammonium, mono-, di-, tri- or tetra-$C_1$–$C_4$-alkylammonium, mono-, di- or tri-$C_1$–$C_4$-hydroxyalkylammonium or ammonium that is di- or tri-substituted by a mixture of $C_1$–$C_4$-alkyl and $C_1$–$C_4$-hydroxyalkyl groups,

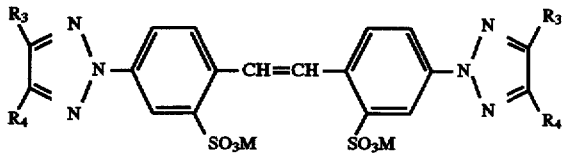

(2)

in which $R_3$ and $R_4$, independently, are H, $C_1$–$C_4$-alkyl, phenyl or monosulfonated phenyl; and M is as defined above,

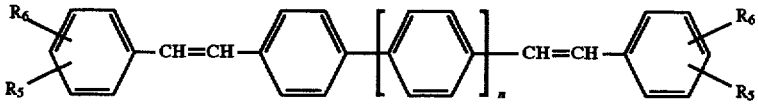

(4)

in which $R_5$ and $R_6$, independently, are H, $SO_3M$, $SO_2N(C_1-C_4\text{-alkyl})_2$, O—($C_1$–$C_4$-alkyl), CN, Cl, $COO(C_1-C_4\text{-alkyl})$, $CON(C_1C_4\text{-alkyl})_2An^{\ominus}$ or $O(CH_2)_3N^{\oplus}(CH_3)_2An^{\ominus}$ in which $An^{\ominus}$ is an anion of an organic or inorganic acid; and n is 0 or 1,

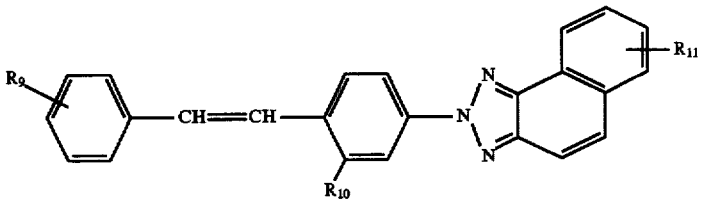

(6)

in which $R_9$ is H or Cl; $R_{10}$ is $SO_3M$, $SO_2N(C_1-C_4\text{-alkyl})_2$, $SO_2O$-phenyl or CN; $R_{11}$, is H or $SO_3M$; and M is as defined above or

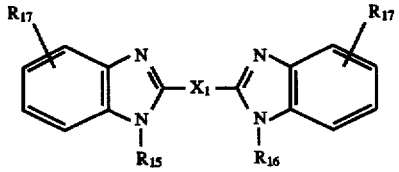

(9)

in which $R_{15}$ and $R_{16}$, independently, are H, $C_1$–$C_4$-alkyl or $CH_2CH_2OH$, $R_{17}$ is H or $SO_3M$; $X_1$ is —CH=CH— or a group of formula:

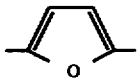

for polyester fabrics, a fluorescent whitening agent of formula (4), (6),

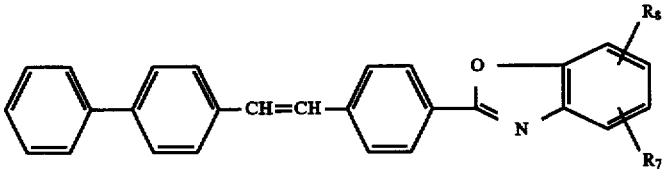

(5)

in which $R_7$ and $R_8$, independently, are H, Cl, $C_1$–$C_4$-alkyl or $SO_2$—$C_1$–$C_4$-alkyl,

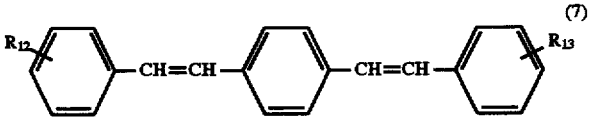

(7)

in which $R_{12}$ and $R_{13}$, independently, are H, $SO_3M$, $SO_2N(C_1-C_4\text{-alkyl})_2$, O—($C_1$–$C_4$-alkyl), CN, Cl, $COO(C_1-C_4\text{-alkyl})$, $CON(C_1-C_4\text{-alkyl})_2$ or $O(CH_2)_3N^{\oplus}(CH_3)_2An^{\ominus}$ in which $An^{\ominus}$ is an anion of an organic or inorganic acid,

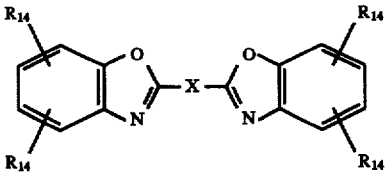

(8)

in which $R_{14}$, independently, is H, $C(CH_3)_3$, $C(CH_3)_2$-phenyl, $C_1$–$C_4$-alkyl or COO—$C_1$–$C_4$-alkyl, and X is —CH=CH— or a group of formula:

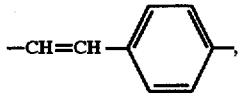

(10)

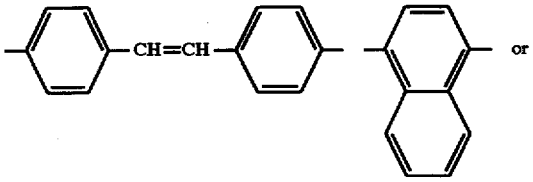

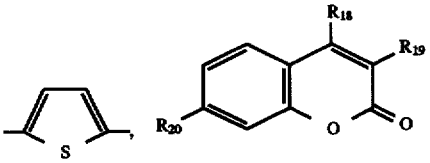

in which $R_{18}$ is H, Cl or $CH_2COOH$, $R_{19}$ is H, phenyl, COO—$C_1$–$C_4$-alkyl or a group of formula:

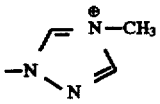

and $R_{20}$ is O—$C_1$–$C_4$-alkyl, $N(C_1-C_4\text{-alkyl})_2$, NH—CO—$C_1$–$C_4$-alkyl or a group of formula:

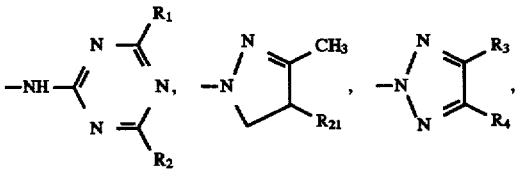

or

-continued

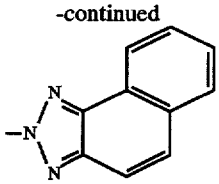

in which $R_1$, $R_2$, $R_3$ and $R_4$ are as defined above and $R_{21}$ is H, $C_1$–$C_4$-alkyl or phenyl,

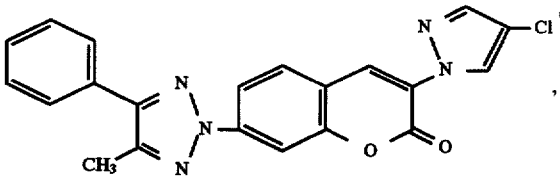

(12)

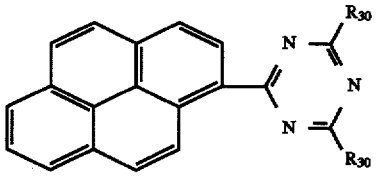

(19)

in which each $R_{30}$, independently, is $C_1$–$C_4$-alkoxy, or

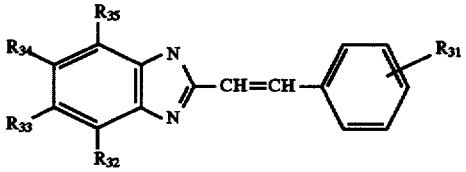

(20)

in which $R_{31}$ is CN, Cl, COO—$C_1$–$C_4$-alkyl or phenyl; $R_{32}$ and $R_{33}$ are the atoms required to form a fused benzene ring or $R_{33}$ and $R_{35}$, independently, are H or $C_1$–$C_4$-alkyl; and $R_{34}$ is H, $C_1$–$C_4$-alkyl or phenyl is used;

for the treatment of polyamide, a fluorescent whitening agent of formula (1), (2), (4), (5), (6), (7), (8), (10),

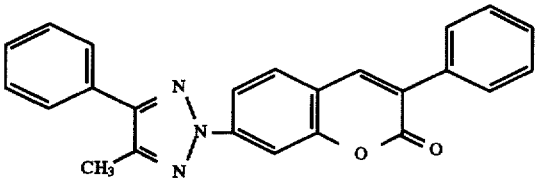

(11)

or (20) is used;

for the treatment of polyacrylonitrile, a fluorescent whitening agent of formula (6), (9), (10), (11), (12) or

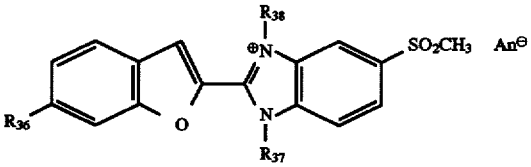

(21)

in which $R_{36}$ is $C_1$–$C_4$-alkoxy; $R_{37}$ and $R_{38}$, independently, are $C_1$–$C_4$-alkyl; and $An^{\ominus}$ is as defined above is used;

for wool or silk, a fluorescent whitening agent of formula (1), (2), (4), (6), (9), (10) or (11) is used;

and for polypropylene, a fluorescent whitening agent of formula (8) is used.

* * * * *